United States Patent [19]

Cubberly, Jr.

[11] 4,166,216

[45] Aug. 28, 1979

[54] METHODS AND APPARATUS FOR DETERMINING DYNAMIC FLOW CHARACTERISTICS OF PRODUCTION FLUIDS IN A WELL BORE

[75] Inventor: Walter E. Cubberly, Jr., Houston, Tex.

[73] Assignee: Schlumberger Technology Corporation

[21] Appl. No.: 835,934

[22] Filed: Sep. 23, 1977

[51] Int. Cl.[2] ..... G01V 3/00

[52] U.S. Cl. ..... 250/260; 250/356

[58] Field of Search ..... 250/260, 264, 265, 266, 250/303, 356, 432 R, 435; 73/155

[56] References Cited

U.S. PATENT DOCUMENTS

| | | | |
|---|---|---|---|
| Re. 27,272 | 1/1972 | Young | 250/260 |
| 2,617,941 | 11/1952 | Craggs | 250/260 |
| 2,739,476 | 3/1956 | Atkins | 73/155 |
| 3,156,818 | 11/1964 | Caldwell | 250/356 |
| 4,057,720 | 11/1977 | Paap et al. | 250/270 X |

*Primary Examiner*—Davis L. Willis

[57] ABSTRACT

In the representative embodiments of the new and improved methods and apparatus disclosed herein, a well tool incorporating the principles of the present invention is stationed in a production well and discrete quantities of a water-miscible radioactive tracer and an oil-miscible radioactive tracer are periodically discharged from spaced nozzles on the tool. By means of any of several disclosed types of fluid directors on the tool, flowing connate fluids are diverted through a restriction adjacent to the oil-miscible tracer discharge nozzle so that at least some of any oil bubbles in the connate fluids will be coalesced into larger slugs and be brought into direct contact with the ejected oil-miscible tracer. In this manner, subsequent measurements of the radioactivity level in the well bore fluids passing remote locations in the well bore will provide separate indications from which one or more of the individual dynamic flow characteristics of the produced oil and water can be determined.

70 Claims, 4 Drawing Figures

METHODS AND APPARATUS FOR DETERMINING DYNAMIC FLOW CHARACTERISTICS OF PRODUCTION FLUIDS IN A WELL BORE

Although there are various techniques employing impeller-type flowmeters or tracer-survey tools for determining flow rates or velocities of injection fluids at different depths in fluid-injection wells, such measurement techniques have been generally recognized heretofore as being not well suited for accurately monitoring production wells. Accordingly, the previous practice has been to simply determine those conditions that can be reliably measured in a production well and either make various simplifiying or empirical assumptions regarding any variables that cannot be readily determined or else obtain relevant indirect measurements from which such variables can be computed.

Those who are skilled in the art recognize that perhaps the most-significant factor affecting the accuracy of quantitative or dynamic flow measurements in production wells is that, for the large part, produced connate fluids are ordinarily multiphase fluids, i.e., mixtures of water and/or gas and/or oil in varying and, usually unknown, proportions. As a result, since the dynamic conditions at a given depth location in a well bore are directly dependent upon the associated pressure and temperature, it is unreliable to use measurements obtained at one depth for accurately predicting dynamic conditions at other depth locations in the well. Similarly, surface measurements can rarely be used to accurately predict downhole flow conditions. For instance, it is not uncommon for a well to be producing both hydrocarbons and water even though the oil recovered at the surface appears to be free of water. On the other hand, the production of oil, gas and water at the surface is not necessarily indicative of triphasic flow conditions at all depths in a well since the pressures at extreme depths are usually sufficient to keep most or all of the gas in solution.

Where the fluids being produced from a given well are a mixture of water and oil, at any given depth location the velocity of the oil phase of the mixture will always be substantially greater than that of the associated water phase regardless of which fluid predominates at that depth location; and in a typical multiple-zone well, the ratio of these velocities will ordinarily vary from one depth location to another. Moreover, under normal well bore conditions, it is not at all uncommon for an oil/water mixture of connate fluids flowing at lower depths to be in the form of oil bubbles moving rapidly through a slowly-moving stream of water and, as more oil enters the well bore from higher production zones, for this situation to be reversed at higher locations. Similar changes will, of course, occur whenever gas is also being produced inasmuch as the size and number of entrained gas bubbles will increase as the production fluids moved upwardly. As a result, the dynamic flow conditions at different depth locations in a production well are often unpredictable and the fluids at any given depth can be in different states or phases respectively traveling at different velocities.

It will be understood, therefore, that determining the dynamic characteristics of multiphase fluids flowing at different depths in a typical production well is not easy. With impeller-type flowmeters, it is not always possible to accurately calibrate the tool for measuring the flow rate of liquids where biphasic or triphasic conditions exist. Similarly, although the measurement of water velocities is usually possible with conventional tracer-survey tools in water-injection wells, when such tools are operated in production wells with multiphase fluids it has not been possible heretofore to accurately measure the velocity of oil passing the tool because of the difficulty of reliably mixing a tracer with such bubbles.

Accordingly, it is an object of the present invention to provide new and improved tracer-survey methods and apparatus for obtaining measurements representative of the individual dynamic flow characteristics of both the water and oil phases constituting typical biphasic connate fluids at one or more depth locations in a given production well.

This and other objects of the present invention are attained by directing connate fluids flowing at a selected depth location in a well bore into a restricted flow path and periodically discharging minor amounts of a suitable radioactive tracer into that flow path for promoting intimate mixing of that tracer material with at least some of any upwardly-flowing oil bubbles which may then be passing the selected depth location. Thereafter, by monitoring the level of radioactivity present in the connate fluids at a higher depth location in the well bore beyond the restricted flow path, measurements will be obtained which are representative of the dynamic flow characteristics of the oil phase at that higher depth location. Similarly, by periodically discharging discrete minor amounts of a suitable radioactive tracer into the connate fluids and again monitoring the level of radioactivity in the connate fluids at one or more depth locations which are remote from the restricted flow path, additional measurements will also be obtained which are representative of the dynamic flow characteristics of water at such remote depth locations in the well bore.

To practice the methods of the present invention, further objects of the invention are attained by arranging fluid-directing means on a tool body for defining a restricted passage through which connate fluids flowing upwardly in a well bore will pass and, where oil is present in such fluids, gather at least some of such oil into coalesced bodies. Tracer-ejecting means are also arranged on the tool body for selectively discharging a radioactive tracer directly into such bodies of oil coalesced within the restricted passage as well as for selectively discharging a radioactive tracer into water in the well bore fluids. Tracer-detecting means are further arranged at one or more remote measuring points on the tool body outside of the restricted passage for obtaining independent measurements representative of variations in the level of radioactivity in the oil phase and water phase of biphasic connate fluids passing such measuring points from which one or more independent dynamic flow characteristics of such fluid phases can be determined.

The novel features of the present invention are set forth with particularity in the appended claims. The invention together with further objects and advantages thereof, may be best understood by way of the following description of exemplary methods and apparatus respectively employing the principles of the invention as illustrated in the accompanying drawings, in which:

Figures 1, 2:
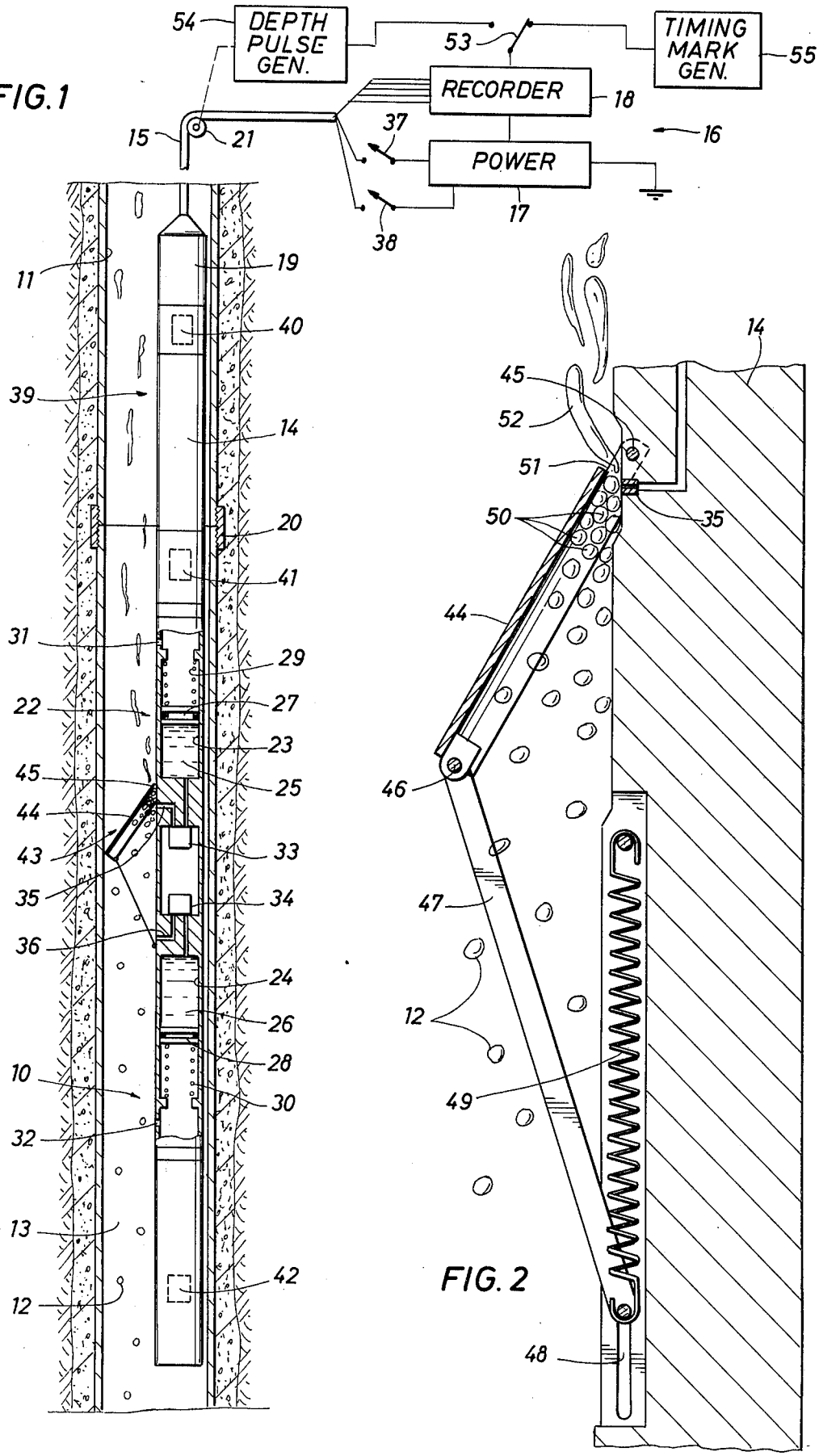
FIG. 1 is a somewhat-schematic presentation of a preferred embodiment of a new and improved tracer-survey tool as it may appear while performing the methods of the present invention in a typical production well for determining the individual dynamic flow characteristics of connate oil and water being produced from the well.
FIG. 2 is an enlarged view of the ejector section of the survey tool shown in FIG. 1 depicting the ejection of a fluent tracer material into a stream of oil bubbles then passing the tool.

Turning now to FIG. 1, a new and improved tracer-survey tool 10 arranged in accordance with the principles of the present invention is shown while practicing the methods of this invention for determining dynamic flow conditions of oil/water mixtures of connate fluids flowing within a typical cased production well as at 11. As is common, the connate fluids flowing at the particular depth location in the well 11 depicted in FIG. 1 are comprised of a stream of dispersed hydrocarbon or oil bubbles, as at 12, which are rapidly rising through a slower-moving stream of water as at 13. The velocity of the hydrocarbon bubbles, as at 12, will as previously mentioned always be significantly greater than the velocity of the adjacent water stream as at 13; and, in many cases, these bubbles will be distributed fairly uniformly acorss the full cross-sectional area of the cased well bore 11.

The preferred embodiment of the new and improved tracer-survey tool 10 shown in FIG. 1 includes an elongated body 14 dependently suspended from a typical logging cable 15 which is spooled on a powered winch (not shown) at a convenient surface location adjacent to the well 11. As is usual, the cable 15 has one or more electrical conductors that are cooperatively coupled to surface instrumentation 16 which preferably includes a selectively-controlled source of electrical power 17 and recording means such as a typical CRT recorder 18 arranged for individually recording various electrical output signals on suitable recording media such as a movable roll of film which is progressively advanced as a function of either time or depth. A typical collar locator 19 is also preferably mounted on the upper end of the tool body 14 and coupled to the cable 15 for providing distinctive electrical output signals as the tool is moved past couplings or casing collars, as at 20, in the cased well bore 11. The surface instrumentation 16 further includes a depth-measuring wheel 21 arranged in a typical fashion to utilize the travel of the cable 15 for progressively driving film through the recorder 18 in proportion to the movements of the survey tool 10 to a selected measuring station in the well bore 11 so as to provide a log record of the respective depth location of the collars 20.

To identify fluids in the well bore 11, the survey tool 10 is also provided with tracer-ejecting means 22 selectively controllable by way of the surface instrumentation 16 and adapted for repetitively discharging discrete amounts of fluent tracer materials into the well bore. In the preferred embodiment of the survey tool 10 shown in FIG. 1, the tracer-ejecting means 22 include upper and lower enclosed chambers 23 and 24 spatially disposed within the tool body 14 for respectively containing pressured fluent tracers such as typical radioactive liquid tracers 25 and 26. To maintain the liquid tracers 25 and 26 at pressures which are at least slightly greater than the hydrostatic pressure of the connate fluids in the well 11, piston members 27 and 28 are respectively arranged in the fluid chambers 23 and 24 and normally biased as by compression springs 29 and 30 for maintaining the tracer contained in each chamber at predetermined elevated pressures. Ports 31 and 32 are arranged in the body 14 for communicating the hydrostatic pressure of the well fluids with the pistons 27 and 28. With the illustrated arrangement of the new and improved survey tool 10, the tracers 25 and 26 will, of course, be maintained at elevated pressures which exceed the well bore pressure at the present depth location of the tool by a pressure differential that is proportional to the predetermined forces respectively provided by the springs 29 and 30.

To control the release of the tracers 25 and 26 from their respective chambers 23 and 24, in the preferred embodiment of the survey tool 10 the tracer-ejecting means 22 further include normally-closed solenoid valves 33 and 34 that are fluidly coupled to each of the chambers and respectively arranged, upon being opened, for selectively communicating the chambers with discharge ports or laterally-directed orifices 35 and 36. Switches 37 and 38 are cooperatively arranged within the surface instrumentation 16 to connect the power source 17 by way of selected conductors in the cable 15 to the solenoid valves 33 and 34 as required for individually ejecting discrete volumes of the tracers 25 and 26 into the well bore 11 upon command.

The new and improved survey tool 10 also includes tracer-detecting means 39 cooperatively arranged for supplying distinctive output signals to the surface instrumentation 16 whenever there is a movement past the tool of either of the well bore fluids 12 and 13 bearing discrete amounts of the tracers 25 and 26 previously released from the tracer-ejecting means 22. As depicted in FIG. 1, in the preferred embodiment of the tracer-survey tool 10, the tracer-detecting means 39 include remotely-located detectors such as an upper pair of typical radiation detectors 40 and 41 mounted at longitudinally-spaced intervals above the upper tracer nozzle 35 and a lower single radiation detector 42 mounted below the lower tracer nozzle 36. As is conventional, the radiation detectors 40–42 are each coupled to suitable amplifiers and other downhole electronic circuitry (not shown) sealingly enclosed in the tool body 14, with these elements all being cooperatively arranged for producing individual output electrical signals from each detector that are transmitted to the surface instrumentation 16 by way of electrical conductors in the cable 15 for being displayed on the CRT recorder 18 and, as its associated film is advanced at a constant and known speed, these measurements are successively recorded as individual curves functionally related to time.

Those skilled in the art will appreciate, of course, that the accuracy and reliability of the measurements provided by the new and improved survey tool 10 will be directly related to how completely and quickly the tracers 25 and 26 become intermixed with the connate fluids 12 and 13 flowing past the tool. It should also be recognized that by using tracer materials which are intimately associated with or previously dissolved in a carrier liquid that is easily mixed or highly soluble within the particular connate fluid that is to be measured, the subsequent intermixing of these substances in the well bore fluids will be significantly promoted. Accordingly, in the practice of the present invention, it is preferred that one of the tracer materials, such as at 25, be an oil-miscible radiation-emitting liquid and that the other tracer material, as at 26, be a water-miscible radiation-emitting liquid. In this manner, use of the oil-miscible tracer 25 will facilitate subsequent measurements of the movement of connate hydrocarbon fluids as at 12. Similarly, the use of the water-miscible tracer 26 will be of particular advantage in following the movements of connate water, as at 13, in the well bore 11.

It has been found, however, that when the flow of biphasic connate fluids includes a stream or so-called "continuous phase" of one fluid (such as the water 13 in FIG. 1) through which the other fluid is moving in the form of discrete bubbles (such as the oil bubbles 12 in FIG. 1), it is difficult, if not impossible from a practical standpoint, to reliably achieve intermixing of the tracer fluid, as at 25, with the connate bubbles even though the tracer carrier is otherwise fully compatible with the connate fluid from which those bubbles are formed. This is true whether the bubbles are hydrocarbons or water. Instead, based upon observations during laboratory tests simulating dynamic flow conditions in a vertical pipe, it appears that with conventional tools and techniques, the ejected tracer material (such as the oil-miscible liquid 25) will ordinarily be discharged into the well bore 11 and then merely rise in a separate stream of discrete tracer bubbles passing through the continuous-phase fluid (such as the connate water 13) and the tracer will never enter nor become intimately intermixed with the bubbling connate fluid (such as the oil bubbles 12). This, of course, allows the separate tracer bubbles to move, at least for the large part, wholly independently of either the connate fluid (e.g., the oil bubbles 12) or the continuous-phase fluid (e.g., the stream of water 13).

Accordingly, to achieve the objects of the present invention and to provide means for selectively identifying oil passing the new and improved tracer-survey tool 10, the tool is further provided with means, as shown generally at 43, for diverting or directing at least a portion of the upwardly-moving oil bubbles, as at 12, along a closely-restricted and defined flow path lying immediately in front of the discharge nozzle 35 through which the oil-miscible tracer is to be ejected as the survey tool is operated. In the preferred embodiment of the survey tool 10, the fluid-diverting means 43 include an elongated, depending deflector 44 having its upper end pivotally mounted, as at 45, on the tool body 14 immediately above the nozzle 35. To control the deflector 44, its lower end is pivotally coupled, as at 46, to an upwardly-inclined strut or support arm 47 having its lower end movably coupled to the body 14 such as by way of a slide member 48 slidably mounted in an elongated longitudinal groove on the tool body. Biasing means such as a tension spring 49 are arranged for urging the slide block 48 upwardly so as to maintain the deflector in its illustrated normally-extended position. By shaping the underside of the deflector 44 to define a generally-arcuate or concave cross-section, the deflector will, upon its extension, present a substantial obstruction to the upwardly-moving oil bubbles, as at 12, but still be capable of lying fairly close to the tool body 14 whenever the deflector is fully retracted.

It will, of course, be appreciated that by dependently mounting the deflector 44 on the tool body 14 whenever the tool 10 is being moved upwardly and an obstruction is encountered such as the lower end of a tubing string, the deflector will be urged downwardly toward its retracted position as the force of the biasing spring 49 is overcome. Similarly, by virtue of the illustrated upward and outward inclination of the support arm 47, should an obstruction be encountered as the survey tool 10 is being lowered in the well bore 11 the arm will be shifted inwardly as necessary to retract the deflector 44 and allow the tool to clear the obstruction.

When the new and improved survey tool 10 is stationed at a selected depth location in the well bore 11 and is in readiness for operation, it will be appreciated that a series of measurements must be successively obtained for respectively determining the flow characteristics of the two connate fluids 12 and 13. Accordingly, to obtain measurements from which the flow velocity of the oil bubbles, as at 12, can be determined, the power source 17 is momentarily connected, as by the switch 37, to the cable for energizing the solenoid valve 33. In the preferred manner of practicing the present invention, time-based advancement of the film associated with the recorder 18 is begun a short time before the solenoid valve 33 is opened; and, as the valve is opened, a distinctive indicia is produced on the film to serve as a reference point from which subsequent time differentials can be measured. To accomplish this, a switch 53 which alternatively connects the recorder 18 to a depth pulse generator 54 when depth-based measurements are desired is operated to now connect the recorder to a typical computer-controlled clock or timing-mark generator 55 for producing a series of time-based reference indicia on the recorder film as it is advanced through the recorder.

So long as the solenoid valve 33 is open, the relatively constant force of the spring 29 acting on the piston 27 will, of course, be effective for expelling a measured minor amount of the oil-miscible tracer 25 from the nozzle 35. As illustrated in FIG. 2, this will direct a concentrated stream of the tracer 25 along the discharge axis of the nozzle so that the tracer enters directly into any nearby bubbles of oil, as at 50, which may then be passing through the narrowed or restricted opening, as at 51, defined between the tool body 14 and the arcuately-shaped upper edge of the deflector 44.

As another significant aspect to the present invention, it will be noted that in addition to diverting many of the oil bubbles, as at 50, through the restricted opening 51, the concave shape of the deflector 44 is also effective for bringing many of these diverted bubbles into the immediate proximity of one another so that often a substantial portion of them will be coalesced into larger bubbles or so-called "slugs" as at 52. It will be appreciated, therefore, that as a coalesced slug, as at 52, passes through the restricted opening 51, the expelled stream of the tracer 25 will be even more apt to penetrate the outer envelope of the oil slug. This will, of course, result in the oil-miscible tracer 25 being quite effective for providing accurate measurements representative of the actual velocity of the oil-phase connate fluids 12.

When the velocity of the water-phase connate fluids, as at 13, is to be measured, the switch 38 is momentarily closed to energize the solenoid valve 34 for ejecting a discrete amount of the water-miscible tracer 26. Hereagain, the switch 53 is operated to couple the recorder 18 to the timing-mark generator 55; and the recording film is advanced through the recorder at a constant, known speed and, again, a second distinctive indicia is produced on the film upon opening of the valve 34. The actual volume of the tracer 26 expelled during a given measurement cycle will, of course, be directly related to the length of time that the solenoid valve 34 remains open inasmuch as the spring 30 maintains the pressure in the chamber 24 at a constant differential above the pressure in the well bore 11.

Since the water 13 at the depth location illustrated in FIG. 1 is flowing in an uninterrupted stream or continuous phase, ejection of a discrete volume of the water-miscible tracer 26 will, of course, be effective for achieving an intimate mixture of the tracer with whatever portion of the water that is then flowing past the nozzle 36. Thus, operation of the solenoid valve 34 will quickly increase the level of radiation in the then-adjacent portion of the connate water as at 13; and this increased radiation level will be subsequently detected as that portion of water passes either the lower detector 42 or the upper detectors 40 and 41. Those skilled in the art will, of course, appreciate that by knowing the physical dimensions of the tool 10, the time required for the irradiated water portion to respectively pass any of the detectors 40–42 can, of course, be readily converted to measurements representative of the average velocity of the connate water 13 then flowing in that interval of the well bore 11. Once the velocity of the connate water phase 13 is determined, the flow rate of the water can be established with ease.

Similarly, when a measurement is to be made of the velocity of the oil bubbles, as at 12, the switch 37 is momentarily closed for actuating the solenoid valve 33 so as to expell a discrete volume of the oil-miscible tracer 26 into the well bore 11. As previously described, the deflector 44 is effective for gathering at least some of the upwardly-flowing bubbles of oil, as at 50, and coalescing such bubbles into larger slugs of oil as at 52. Thus, should one or more oil slugs, as at 52, be passing through the restriction 51 during the time interval that the tracer 25 is being ejected, these slugs will ordinarily be penetrated by a sufficient quantity of tracer that the subsequent movement of either these slugs or bubbles which may reform as the slugs divide past the upper detectors 40 and 41 will be effective for producing corresponding measurement signals on the surface instrumentation 16. Hereagin, those skilled in the art will understand that these measurements can be employed for deriving the actual velocity of the oil bubbles, as at 12, in that interval of the well bore 11.

It is of particular significance to the present invention that the several detectors 40–42 are respectively located outside of the flow restriction defined by the deflector 44 and, preferably, at a sufficient distance therefrom to allow the connate fluids 12 and 13 to resume their normal flow patterns.

It will be recognized, of course, that there will be times that little or no signal response is observed on the surface instrumentation 16 following a given operation of the solenoid valve 33. Ignoring malfunctions of the tool 10, such lack of signal response can mean only that there had been little or no flow of oil at that depth in the well bore 11 during the brief interval that the oil-miscible tracer 25 was being ejected. By repetitively ejecting discrete amounts of the tracer 25, it can, of course, be quickly determined whether there is any oil actually flowing at that depth. It should be noted in passing that (at least under laboratory conditions) whenever the stream of the tracer 25 fails to penetrate an oil bubble or slug, as at 52, the ejected tracer will ordinarily be in the form of very minute bubbles of the oil-miscible tracer, with these small bubbles being widely dispersed throughout the water stream 12 that the subsequent movement of the tracer past the upper detectors 40 and 41 will be substantially at the same velocity as the water stream.

Figure 3:
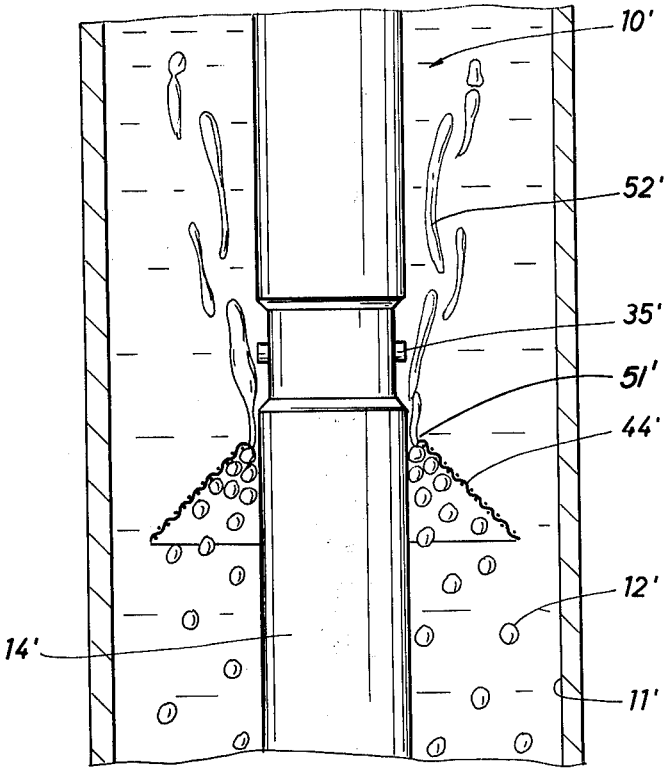
FIGS. 3 and 4 respectively illustrate alternative embodiments of other new and improved tracer-survey tools which may also be advantageously employed for performing the methods of the present invention.

The new and improved survey tool 10 as illustrated in FIG. 1 is, of course, best operated under conditions with substantial flows of oil bubbles as at 12. Accordingly, to allow for those situations where only minor flows of oil are anticipated, the principles of the present invention can also be carried out with larger or more effective fluid deflectors than the deflector 44. As depicted in FIG. 3, for example, a new and improved tracer-survey tool 10' can also be devised by employing a flexible funnel-like deflector 44' which is mounted in an inverted position on a tool body 14' that is otherwise identical to the tool body 14. Although various constructional arrangements can be adopted to provide the readily-collapsible frustoconical deflector, it is preferred to form the deflector 44' from a closely-meshed screen of suitable material and support the screen material on a plurality of circumferentially-spaced, outwardly-extending flexible ribs. Hereagain, as was the case with the survey tool 10, the alternative tool 10' is also arranged so that the top of the screen deflector 44' defines a restricted annular opening 51' around the tool body 14' through which coalesced oil slugs, as at 52', can readily pass. Although the screen 44' can just as well be located with its top immediately above the nozzle 35' for the oil-miscible tracer substance, the screen can also be located as depicted so as to position the opening 51' immediately below that nozzle. Inasmuch as the arrangement of the survey tool 10' is otherwise identical to the tool 10, no further discussion is believed necessary for understanding either the construction of this alternative tool or its operation.

Figure 4:
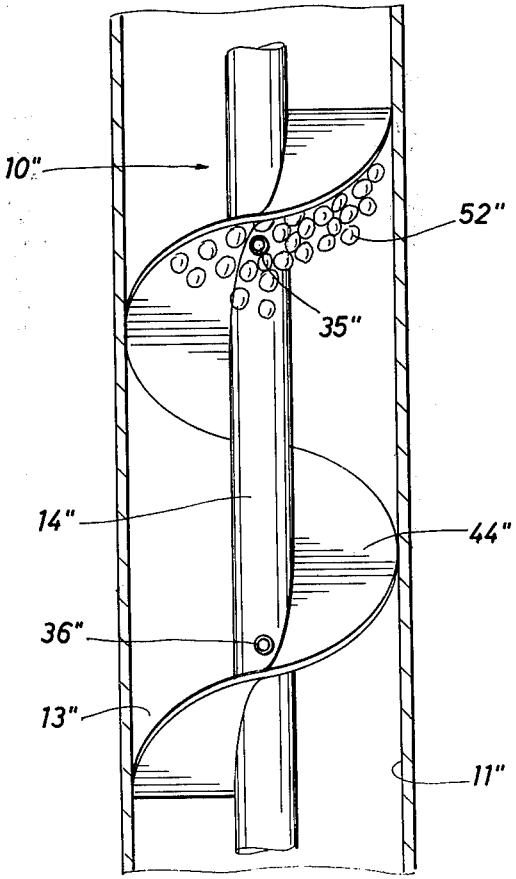

Turning now to FIG. 4, still another survey tool 10'' is depicted which also incorporates the principles of the present invention by having a laterally-projecting fluid deflector or baffle 44'' helically disposed around an intermediate portion of the body 14'' or the survey tool and cooperatively arranged for restricting upward flow of connate fluids in the well bore 11''. In its preferred embodiment, the baffle 44'' is formed of a somewhat-flexible strip of an appropriate material such as a closely-meshed metal screen of fluid-impervious plastic which is wound in a helix around the intermediate portion of the tool body 14'' so as to complete at least one full turn. By arranging the helically-wound baffle 44'' to be of sufficient width that its outer edge at least approaches the wall of the well bore 11'', an upwardly-inclined circuitous or serpentine flow passage or helical channel is defined around the tool body 14'' from a fluid inlet below an ejector nozzle 36'' to a fluid outlet above a higher ejector nozzle 35''.

Accordingly, it will be recognized that by virtue of the restriction to upward flow as well as the somewhat-quiescent conditions promoted within the restricted passage defined by the helical baffle 44'', connate fluids flowing at low to moderate flow rates in the well bore 11'' can possibly achieve at least a partial segregation or vertical separation within the passage according to their respective fluid densities. In this manner, as oil bubbles move through the helical passage defined by the baffle 44'', these bubbles, as at 12'', will rise and, as they collect in the higher portion of the restricted passage, they will move as coalesced slugs of oil, as shown at 52'', at a faster rate than a slower-moving stream of water, as at 13'', which will tend to collect in the lower portion of the passage. Thus, in keeping with the principles of the present invention, by arranging the upper nozzle 35'' to eject oil-miscible tracer materials into the higher portion of the passage close to the upper end of the baffle 44", oil bubbles moving up the restricted passage will have had an opportunity to be coalesced into slugs, as at 52", thereby improving the odds that an oil-miscible tracer will penetrate the upwardly-moving oil stream. In a similar fashion, the lower nozzle 36" is arranged to discharge a water-miscible tracer material into the water stream 13". Hereagain, by positioning the nozzle 36" in the lower portion of the helical passage defined by the baffle 44", it can be reasonably anticipated that when a water-miscible tracer is discharged from the nozzle there will be a good chance that any water then flowing in the passage will be immediately contacted by the tracer.

Accordingly, it will be recognized that the present invention provides new and improved methods and apparatus for determining the dynamic flow characteristics of oil/water mixtures of produced connate fluids flowing in a well bore. By arranging a fluid deflector on a tracer-survey tool for cooperatively diverting at least a portion of the flowing connate fluids through a narrowed or restricted flow passage immediately adjacent to a fluid-discharge opening through which fluent tracers are selectively ejected, as oil bubbles or slugs pass through the restricted passage tracers ejected from the nozzle will be more apt to become intimately mixed with the oil bubbles. In a similar fashion, a radioactive tracer is also ejected from time to time into connate water passing the tool. Thus, by successively monitoring the level of radioactivity of connate fluids passing at least one higher depth location in the well bore, measurements may be obtained which will be representative of the individual flow characteristics of the oil and water phases in that interval of the well bore.

While only a particular embodiment of the present invention and modes of practicing the invention have been shown and described, it is apparent that changes and modifications may be made without departing from this invention in its broader aspects; and, therefore, the aim in the appended claims is to cover all such changes and modifications as fall within the true spirit and scope of this invention.

What is claimed is:

1. A method for determining individual dynamic flow characteristics of biphasic connate fluids in a production well and comprising the steps of:

temporarily gathering at least some of any discontinuous-phase oil flowing through continuous-phase water at a selected depth location in said production well into coalesced bodies of such oil and directing such coalesced bodies along a restricted channel;

discharging a radioactive tracer along an axis intersecting the flow path of fluids moving along said restricted channel during one time interval for mixing a detectable quantity of that tracer with at least one coalesced body of oil directed along said restricted channel;

monitoring the level of radioactivity in said production well above said restricted channel after said one time interval for obtaining at least one indication representative of the movement of tracer-bearing oil through the continuous-phase connate water above said selected depth location;

discharging a radioactive tracer into the connate fluids during another time interval for mixing a detectable quantity of that tracer with at least some of the continuous-phase water at said selected depth location; and monitoring the level of radioactivity in said production well beyond said restricted channel after said other time interval for obtaining at least another indication representative of the movement of tracer-bearing connate water beyond said selected depth location.

2. The method of claim 1 further including the steps of:

measuring the elapsed time between the discharge of said radioactive tracer during said one time interval and the reception of said one indication for determining the travel time of such coalesced bodies of oil between the discharge point of said radioactive tracer and one monitoring point where said one indication is received; and measuring the elapsed time between the discharge of said radioactive tracer during said other time interval and the reception of said other indication for determining the travel time of the continuous-phase water between the discharge point of said radioactive tracer and another monitoring point where said other indication is received.

3. The method of claim 1 further including the steps of:

measuring the elapsed time between the discharge of said radioactive tracer during said one time interval and the reception of said one indication for determining the travel time of such coalesced bodies of oil between the discharge point of said radioactive tracer and one monitoring point where said one indication is received;

dividing the distance between said discharge point and said one monitoring point by said travel time for determining the velocity of the discontinuous-phase oil at said selected depth location;

measuring the elapsed time between the discharge of said radioactive tracer during said other time interval and the reception of said other indication for determining the travel time of the continuous-phase water between the discharge point of said radioactive tracer and another monitoring point where said other indication is received; and dividing the distance between said discharge point and said other monitoring point by said travel time for determining the velocity of the continuous-phase water at said selected depth location.

4. The method of claim 1 wherein said radioactive tracer discharged during said one time interval is preferentially miscible with oil.

5. The method of claim 1 wherein said radioactive tracer discharged during said other time interval is preferentially miscible with water.

6. The method of claim 1 wherein said radioactive tracer discharged during said one time interval is preferentially miscible with oil, and said radioactive tracer discharged during said other time interval is preferentially miscible with water.

7. The method of claim 6 wherein said water-miscible tracer is discharged into said production well outside of said restricted channel.

8. The method of claim 1 wherein said flow path extends through a defined exit opening of said restricted channel through which such coalesced bodies of oil will pass, and said axis of discharge intersects said flow path immediately adjacent to said defined exit opening.

9. The method of claim 8 wherein said axis of discharge intersects said flow path within said restricted flow channel immediately below said defined exit opening.

10. The method of claim 8 wherein said axis of discharge intersects said flow path in said defined exit opening.

11. The method of claim 8 wherein said axis of discharge intersects said flow path adjacent to and immediately above said defined exit opening.

12. The method of claim 8 wherein said flow path extends through an enlarged lower entrance opening and a reduced upper exit opening of said restricted channel through which such coalesced bodies of oil will pass.

13. The method of claim 12 wherein said axis of discharge intersects said flow path immediately adjacent to said upper exit opening.

14. The method of claim 1 wherein said restricted channel is an upwardly-inclined and circuitous channel terminating in an upper exit opening.

15. The method of claim 14 wherein said axis of discharge is adjacent to and immediately below said upper exit opening.

16. The method of claim 15 wherein said radioactive tracer discharged during said other time interval is discharged into said circuitous channel below said upper exit opening.

17. A method for determining individual dynamic flow characteristics of biphasic connate fluids in a production well and comprising the steps of:

diverting the connate fluids within a selected interval of said production well into a restricted flow path for temporarily gathering at least some of any discontinuous-phase oil flowing through continuous-phase water within said selected well interval into coalesced bodies of such oil and directing such coalesced bodies along said restricted flow path;

discharging a radioactive tracer along an axis intersecting said restricted flow path for promoting intimate mixing of a detectable quantity of that tracer with at least some of any such coalesced bodies of oil which may be intercepted thereby;

monitoring the level of radioactivity in said production well above said flow path for providing one set of measurement signals which are functionally dependent upon the travel time of tracer-bearing oil moving between spaced locations in said selected well interval;

discharging a radioactive tracer into the connate fluids within said selected well interval for promoting intimate mixing of a detectable quantity of that tracer with at least some of the continuous-phase water that may be intercepted thereby; and monitoring the level of radioactivity in said production well beyond said flow path for providing another set of measurement signals which are functionally dependent upon the travel time of tracer-bearing water moving between spaced locations in said selected well interval.

18. The method of claim 17 further including the steps of:

correlating said one set of measurement signals for obtaining a measurement of the travel time of tracer-bearing oil over a given distance in said selected well interval and then determining the velocity of such tracer-bearing oil in said selected well interval; and correlating said other set of measurement signals for obtaining a measurement of the travel time of tracer-bearing water over a given distance in said selected well interval and then determining the velocity of such tracer-bearing water in said selected well interval.

19. The method of claim 17 wherein said radioactive tracer discharged into the oil is different from said radioactive tracer discharged into the connate water.

20. The method of claim 17 wherein said radioactive tracer discharged into said connate fluids is discharged into said selected well interval outside of said flow path.

21. The method of claim 17 wherein said radioactive tracer discharged along said axis of discharge is preferentially miscible with oil.

22. The method of claim 17 wherein said radioactive tracer discharged into said connate fluids is preferentially miscible with water.

23. The method of claim 17 wherein said radioactive tracer discharged along said axis of discharge is preferentially miscible with oil, and said radioactive tracer discharged into said connate fluids is preferentially miscible with water.

24. The method of claim 22 wherein said water-miscible tracer is discharged into said selected well interval outside of said restricted flow path.

25. The method of claim 17 wherein the upper portion of said restricted flow path extends through a defined exit opening through which such coalesced bodies of oil will pass.

26. The method of claim 25 wherein said radioactive tracer discharged into said connate fluids is discharged into said production well outside of said restricted flow path and beyond said defined exit opening.

27. The method of claim 25 wherein said axis of discharge intersects said restricted flow path immediately adjacent to said defined exit opening.

28. The method of claim 25 wherein said axis of discharge intersects said restricted flow path adjacent to and immediately below said defined exit opening.

29. The method of claim 25 wherein said axis of discharge intersects said restricted flow path in said defined exit opening.

30. The method of claim 25 wherein said axis of discharge intersects said restricted flow path adjacent to and immediately above said defined exit opening.

31. The method of claim 17 wherein said restricted flow path extends through an enlarged lower entrance opening and a reduced upper exit opening through which such coalesced bodies of oil will pass.

32. The method of claim 31 wherein said axis of discharge intersects said restricted flow path immediately adjacent to said upper exit opening.

33. The method of claim 31 wherein said axis of discharge intersects said restricted flow path adjacent to and immediately below said upper exit opening.

34. The method of claim 31 wherein said axis of discharge intersects said restricted flow path in said upper exit opening.

35. The method of claim 31 wherein said axis of discharge intersects said restricted flow path adjacent to and immediately above said upper exit opening.

36. The method of claim 17 wherein said restricted flow path is defined by an upwardly-inclined circuitous channel terminating in an upper exit opening.

37. The method of claim 36 wherein said axis of discharge is adjacent to and immediately below said upper exit opening.

38. The method of claim 37 wherein said radioactive tracer discharged into said connate fluids is discharged into said circuitous channel below said upper exit opening.

39. A method for determining a function representative of the velocities of the continuous-phase water and the discontinuous-phase oil constituents of biphasic connate fluids in a production well and comprising the steps of:

positioning a body defining a restricted upwardly-directed flow passage wherein a selected interval of said production well for temporarily gathering at least some of any discontinuous-phase oil passing through said restricted passage into coalesced bodies of such oil;

discharging a discrete quantity of an oil-miscible radioactive tracer directly into the flow path of such coalesced bodies of oil for promoting intimate mixing of a detectable quantity of that tracer with at least a portion of the discontinuous-phase oil then adjacent to the discharge point of said oil-miscible tracer;

following the discharge of said oil-miscible tracer, successively monitoring the level of radioactivity at a selected measuring station in said selected well interval beyond said restricted passage for obtaining one or more independent measurements from which a determination can be made of the travel time of the discontinuous-phase oil between selected spaced points in said selected well interval;

discharging a discrete quantity of a water-miscible radioactive tracer into such connate fluids for promoting intimate mixing of that tracer with at least a portion of the continuous-phase water then adjacent to the discharge point of said water-miscible tracer; and following the discharge of said water-miscible tracer, successively monitoring the level of radioactivity at a selected measuring station in said selected well interval beyond said restricted passage for obtaining one or more independent measurements from which a determination can be made of the travel time of the continuous-phase water between selected spaced points in said selected well interval.

40. The method of claim 39 wherein the discharge of said oil-miscible tracer precedes the discharge of said water-miscible tracer.

41. The method of claim 39 wherein the discharge of said water-miscible tracer precedes the discharge of said oil-miscible tracer.

42. The method of claim 39 further including the steps of correlating each of said travel time measurements with the distances respectively between said spaced points for determining the velocity of said discontinuous-phase oil and the velocity of said continuous-phase water within said selected well interval.

43. The method of claim 39 wherein said discharge point of said water-miscible tracer is outside of said flow passage.

44. The method of claim 39 wherein said flow passage terminates in an exit opening through which such coalesced bodies of oil must pass.

45. The method of claim 44 wherein said discharge point of said oil-miscible tracer is immediately adjacent to said exit opening.

46. The method of claim 44 wherein said distance point of said oil-miscible tracer is within said flow passage immediately below said exit opening.

47. The method of claim 44 wherein said discharge point of said oil-miscible tracer is directly in said exit opening.

48. The method of claim 44 wherein said discharge point of said oil-miscible tracer is in said flow path adjacent to and immediately above said exit opening.

49. The method of claim 39 wherein said flow passage has an enlarged lower entrance opening and a reduced upper exit opening.

50. The method of claim 49 wherein said discharge point of said oil-miscible tracer is in said flow path and immediately adjacent to said exit opening.

51. The method of claim 49 wherein said discharge point of said oil-miscible tracer is within said flow passage immediately below said exit opening.

52. The method of claim 49 wherein said discharge point of said oil-miscible tracer is directly in said exit opening.

53. The method of claim 49 wherein said discharge point of said oil-miscible tracer is in said flow path adjacent to and immediately above said exit opening.

54. The method of claim 39 wherein said flow passage is an inclined circuitous channel making at least one complete turn around said body and terminating in an upper exit opening.

55. The method of claim 54 wherein said discharge point of said oil-miscible tracer is within said circuitous channel adjacent to and immediately below said exit opening.

56. The method of claim 55 wherein said discharge point of said water-miscible tracer is in said circuitous channel below said discharge point of said oil-miscible tracer.

57. Apparatus adapted for determining dynamic flow characteristics of produced multiphase connate fluids in a production well and comprising:

a body adapted for suspension in a production well;

fluid-diverting means cooperatively arranged on said body to divert connate fluids flowing upwardly past said body along a defined flow path for gathering at least some of any oil contained therein into upwardly-moving coalesced bodies of such oil and directing such coalesced bodies of oil past a selected location along said defined flow path;

tracer-ejecting means arranged on said body including at least one tracer-discharge opening aligned along a discharge axis intersecting said selected flow path location, and selectively-operable tracer-supply means coupled to said tracer-discharge opening and respectively adapted for successively ejecting radioactive tracer materials therethrough; and tracer-detecting means including at least one radiation detector cooperatively arranged on said body above said tracer-discharge opening and beyond said defined flow path and adapted for providing characteristic indications representative of the successive movements of tracer-bearing connate fluids therepast.

58. The apparatus of claim 57 wherein said flow-diverting means include a downwardly and outwardly-inclined fluid diverter cooperatively mounted on said body for defining a restricted opening in the upper portion of said flow path immediately adjacent to said one tracer-discharge opening so as to direct such coalesced bodies of oil across said one tracer-discharge opening.

59. The apparatus of claim 58 wherein said fluid diverter is an elongated member having its upper end positioned adjacent to one side of said body for defining said restricted opening; and further including means pivotally coupling said upper end of said elongated member to said body, and means cooperatively arranged between said body and said elongated member for normally biasing the lower end thereof outwardly from said body.

60. The apparatus of claim 58 wherein said fluid diverter is a frusto-conical member having its smaller upper end cooperatively mounted around said body for defining said restricted opening therearound.

61. The apparatus of claim 57 wherein said flow-diverting means include an elongated strip member of uniform width having one edge thereof wound helically for at least one complete turn around said body and the other edge thereof disposed outwardly from said body for defining said flow path as a generally-helical channel disposed between opposed, longitudinally-separated surfaces of said strip member with the upper portion of said channel passing immediately adjacent to said one fluid-discharge opening so as to direct such coalesced oil across said one fluid-discharge opening.

62. Apparatus adapted for suspension from an electrical cable in a production well for determining dynamic flow characteristics of the water and oil-phase constituents of biphasic connate fluids therein and comprising:

a body;

water-measurement means including a first enclosed chamber on said body and adapted for containing a first fluent radioactive tracer material, a first tracer-discharge opening on said body, first selectively-operable valve means cooperatively arranged for communicating said first chamber with said first tracer-discharge opening in response to an electrical signal, and means on said body adapted for imposing an elevated pressure on fluent materials contained in said first chamber of sufficient magnitude to expel such materials from said first tracer-discharge opening upon opening of said first valve means;

oil-measurement means including a fluid diverter cooperatively arranged on said body and adapted for directing connate fluids flowing upwardly therepast into a restricted upwardly-directed fluid passage for gathering oil included with such fluids into coalesced bodies of oil, a second enclosed chamber on said body and adapted for containing a second fluent radioactive tracer material, a second tracer-discharge opening cooperatively arranged on said body and adjacent to the upper end of said restricted fluid passage and aligned along a discharge axis intersecting the path of fluids in said restricted fluid passage, second selectively-operable valve means cooperatively arranged for communicating said second chamber with said second tracer-discharge opening in response to an electrical signal, and means on said body adapted for imposing an elevated pressure on fluent materials contained in said second chamber of sufficient magnitude to expel such materials from said second tracer-discharge opening upon opening of said second valve means; and tracer-detecting means including at least one radiation detector cooperatively arranged on said body above said tracer-discharge openings and adapted for providing characteristic electrical signals representative of the passage of tracer-bearing fluids therepast.

63. The apparatus of claim 62 wherein said first tracer-discharge opening is exterior of said restricted fluid passage.

64. The apparatus of claim 63 wherein said first tracer-discharge opening is also below the lower end of said restricted fluid passage.

65. The apparatus of claim 62 wherein said fluid diverter is an elongated member having its upper end cooperatively mounted on one side of said body immediately adjacent to said second tracer-discharge opening for defining a restricted exit terminating said restricted fluid passage and its lower end spatially disposed away from said body for defining the entrance of said restricted fluid passage.

66. The apparatus of claim 65 further including means pivotally coupling said upper end of said fluid diverter member to said body; and means cooperatively arranged between said body and fluid diverter member for normally positioning said lower end of said fluid diverter member outwardly from said body.

67. The apparatus of claim 62 wherein said fluid diverter is a frustoconical member coaxially mounted around said body with its smaller upper end adjacent to said body for defining a constricted exit opening terminating said restricted fluid passage and with its larger lower end spatially disposed away from said body for defining an enlarged entrance opening to said restricted fluid passage.

68. The apparatus of claim 67 wherein said fluid diverter member is formed of a flexible material; and further including a plurality of flexible ribs spaced around said body and cooperatively arranged for normally positioning said lower end of said fluid diverter member outwardly from said body.

69. The apparatus of claim 62 wherein said fluid diverter is an elongated strip member having one edge thereof wound helically for at least one turn around said body and its other edge spaced outwardly from said body for defining said restricted fluid passage as a generally-helical channel disposed between the longitudinally-spaced surfaces of said strip member.

70. The apparatus of claim 69 wherein said strip member is of a flexible material.

* * * * *